United States Patent [19]

Watanabe et al.

[11] Patent Number: 4,492,515

[45] Date of Patent: Jan. 8, 1985

[54] PUMP APPARATUS

[75] Inventors: Kiyohiko Watanabe, Chiryu; Kazuma Matsui, Toyohashi; Yoshiyuki Hattori, Toyoake; Toshihiro Takei, Kariya; Toshiaki Nakamura, Anjo; Shunsaku Ohnishi, Toyota, all of Japan

[73] Assignee: Nippondenso Co., Ltd., Kariya, Japan

[21] Appl. No.: 377,546

[22] Filed: May 12, 1982

[51] Int. Cl.[3] ..... F04D 1/02; F04D 1/12

[52] U.S. Cl. ..... 415/53 T; 415/213 T

[58] Field of Search ..... 277/96.1, 96.2; 415/98, 415/53 T, 213 T

[56] References Cited

U.S. PATENT DOCUMENTS

| | | | |
|---|---|---|---|
| 2,396,319 | 3/1946 | Edwards et al. | 415/213 T |
| 2,842,062 | 7/1958 | Wright | 415/213 T |
| 3,233,551 | 2/1966 | Oshima | 415/213 T |
| 3,658,444 | 4/1972 | Rhodes et al. | 415/213 T |
| 3,973,867 | 8/1976 | Lee | 415/213 T |

*Primary Examiner*—Edward L. Roberts
*Assistant Examiner*—Arthur D. Dahlberg
*Attorney, Agent, or Firm*—Cushman, Darby & Cushman

[57] ABSTRACT

A regenerative pump has a pump housing and a disc-like impeller mounted in the pump housing for axial movement therein and rotated by an electric motor. The impeller is provided with circumferential rows of vane grooves formed in the end faces of the impeller adjacent to the outer periphery thereof. The pump housing has inner surfaces closely spaced from the impeller end faces. Circumferentially continuous annular projections or circumferentially discontinuous projections are formed on either the impeller end faces or the housing inner surfaces to keep at least the major surface areas of the impeller end faces closely spaced from the mating inner surfaces of the housing. Axial passages extend through the impeller to equalize fluid pressures on the opposite impeller end faces.

9 Claims, 10 Drawing Figures

PUMP APPARATUS

BACKGROUND OF THE INVENTION

1. Field of the Invention

The present invention relates to a pump apparatus of the kind that comprises a regenerative pump including a pump housing and a disc-like impeller mounted in the pump housing and driving means such as an electric motor for rotating the impeller.

2. Description of the Prior Art

In the field of the pump apparatus of the class specified above, there are two types in respect of driving connection between the pump impeller and the motor shaft. In the first type, the impeller is rigidly secured to the motor shaft by a fixing means such as a screw. In the second type, the impeller is mounted on the motor shaft for rotation therewith but for axial sliding movement thereon. The impellers of either types of the pump apparatus are each provided with circumferential rows of radial grooves formed on the opposite end faces of the impeller adjacent to the outer periphery thereof to form radial vanes for pumping a fluid. The surface areas of the end faces of the impeller disposed radially inwardly of the circumferential rows of radial vanes are disposed in closely spaced relationship to the mating inner surfaces of the pump housing to cooperate therewith to form sealing sections against radially inward flows of the fluid.

In the pump having the first type of driving connection between the impeller and the motor shaft, it is difficult to accurately control the axial dimensions or so-called "side clearances" between the impeller end faces and the mating inner surfaces of the pump housing. It needs well-experienced skill and careful attention to assemble the component parts such that the side clearances between the impeller end faces and the pump housing inner surfaces fall within a predetermined limited range. After the assembling, moreover, if the shaft is axially displaced together with the impeller relative to the pump housing, there would occur a frictional contact between the impeller and the pump housing.

Even in the pump having the second type of driving connection between the impeller and the shaft, if a contact occurs between the impeller and the pump housing, the friction therebetween produces a large magnitude of torque-loss which results not only in fluctuation of the rotational speed of the impeller with a resultant pulsation of the discharge pressure of the pump, but also in wear and break of the impeller and the housing at the point of contact therebetween with resultant appreciable reduction in the pump performance and tendency of stick of the impeller and the housing. In addition, frictional contacts between the impeller and the housing produce fine particles of worn material which also tend to stick the impeller and the pump housing together.

SUMMARY OF THE INVENTION

The present invention has its object to provide a pump apparatus which is free from the above-discussed problems, has an improved durability and provides a high and substantially constant pump performance for a prolonged period of time.

The pump apparatus according to the present invention comprises a regenerative pump including a pump housing formed therein with suction and discharge ports and a disc-like impeller mounted in the housing for rotation therein and for axial movement within a limited range. The impeller is drivingly connected with a driving means for rotating the impeller to thereby pump a fluid. The impeller has substantially circular end faces and is provided with circumferential rows of radial vane grooves formed in the end faces adjacent to the outer periphery of the impeller. The pump housing cooperates with the impeller to define a circumferential fluid passage surrounding the circumferential rows of radial vane grooves and communicated with the suction and discharge ports. The housing has substantially circular inner surfaces directed to the end faces of the impeller, respectively. The pump apparatus is also provided with means for axially centering the impeller within the pump housing to keep at least the major surface areas of the opposite end faces of the impeller closely spaced from the substantially circular inner surfaces of the pump housing. The centering means include spacer means formed on at least one of the impeller and the pump housing.

The above and other objects, features and advantages of the present invention will be made more apparent by the following description with reference to the accompanying drawings.

DESCRIPTION OF REFERRED EMBODIMENTS

Figure 1:
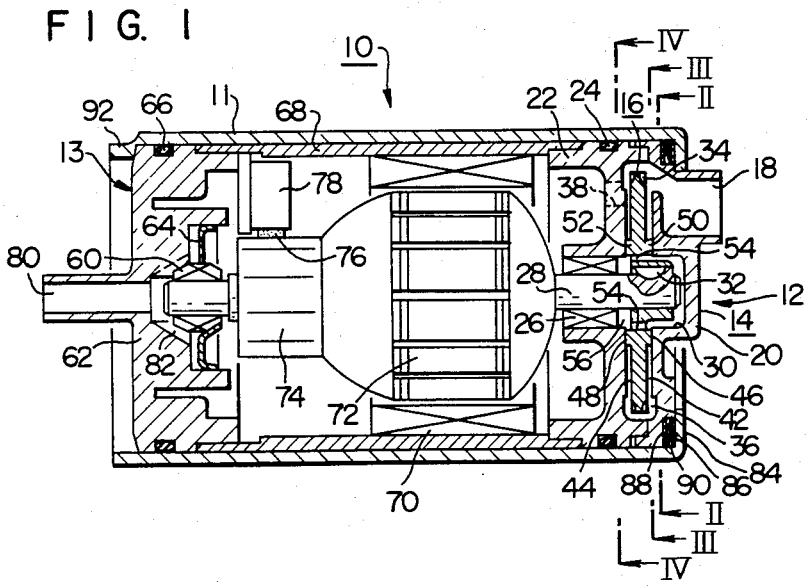
FIG. 1 is an axial sectional view of an electrically operated fuel pump embodying the present invention.
Figure 2:
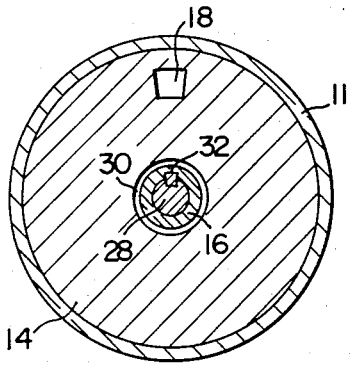
FIGS. 2, 3 and 4 are cross-sectional views of the fuel pump shown in FIG. 1 taken substantially along lines II—II, III—III and IV—IV in FIG. 1, respectively.
Figure 3:
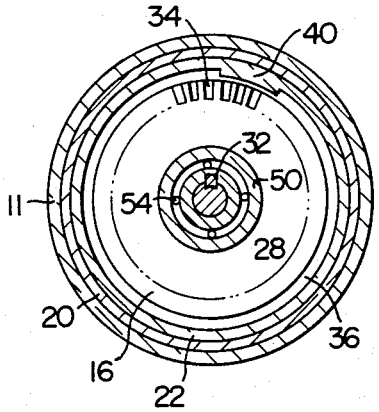
Figure 4:
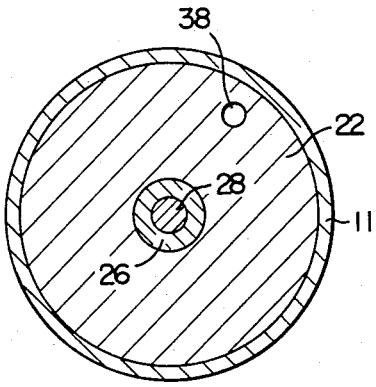

Referring to FIGS. 1 to 4, an electrically operated fuel pump apparatus is generally designated by 10 and includes a casing 11 which houses therein a pump 12 and an electric motor 13. The pump 12 comprises a pump housing 14 and a disc-like impeller 16 rotatably mounted therein. The pump housing 14 comprises an outer section 20 formed therein with a suction port 18 and constituting an end wall of the casing 11 of the pump apparatus 10 and an inner section 22 secured to the outer section 20. An "O" ring 24 is interposed between the outer periphery of the inner section 22 and the inner peripheral surface of the casing 11.

The inner section 22 of the pump housing 14 also acts as a holder for supporting a bearing 26 for the motor 13. The motor has a shaft 28 extending through the bearing 26 and having an outer end extending into a recess 30 formed in the central area of the inner surface of the outer section 20 of the pump housing 14.

The impeller 16 is mounted on the shaft for rotation therewith and for axial sliding movement thereon. The shaft 28 carries thereon a semi-circular key 32 which transmits the torque of the shaft 28 and thus of the motor 13 to the impeller 16. The impeller is provided with circumferential rows of circumferentially spaced radial vane grooves 34 formed in the opposite end faces of the impeller adjacent to the outer periphery thereof so that the vane grooves operate to pump the fluid. The grooved outer marginal section of the impeller 16 and the pump housing 14 cooperate together to define a circumferential fluid passage 36 which is communicated not only with the suction port 18 but also with a discharge port 38 formed in the inner section 22 of the pump housing. As will be seen from the comparison between FIGS. 2 and 4, the suction and discharge ports 18 and 38 are spaced circumferentially of the impeller 16. The pump housing inner section 22 has an integral portion 40 which extends into the circumferential fluid passage 36 between the suction and discharge ports 18 and 38 to form a circumferential partition, as will be seen in FIG. 3. In other words, the circumferential fluid passage 36 is circumferential interrupted by the partition 40.

In the illustrated embodiment of the invention, the outer and inner sections 20 and 22 of the pump housing 14 are engaged such that a cylindrical end portion of the inner section 22 is fitted into a mating cylindrical end portion of the outer section 20 so that the inner peripheral surface of the circumferential fluid passage 36 and the circumferential partition 40 are formed by the inner peripheral surface of the cylindrical inner end portion of the inner section 22. In addition, because the inner section 22 of the pump housing also at as a holder for the motor bearing 26, as discussed previously, the housing inner section 22 can be manufactured with a high degree of accuracy in respect of the concentricity of the inner peripheral surface of the fluid passage 36 and the inner surface of the partition 40 relative to the axis of the impeller 16.

The pump 12 is of the type that is so-called "regenerative pump" which is designed to produce such a high discharge pressure as is required for a fuel pump used in an electronically controlled fuel injection system. For this purpose, the pump 12 is provided with first set of sealing sections 42 and 44 formed between the opposite end faces of the impeller 16 and the adjacent inner surfaces of the pump housing 14. The sealing sections are disposed between the grooved outer marginal section of the impeller 16 and the central area thereof. The clearances or gaps between the impeller end faces and the pump housing at the sealing sections 42 and 44 are usually as small as from 30 to 60 microns but are exaggerated in the drawings.

In addition to the first set of sealing sections 42 and 44, the pump apparatus 10 is provided with a second set of sealing sections 46 and 48 disposed radially inwardly of the first set of sealing sections 42 and 44 to control the gaps between the impeller 16 and the pump housing at the first set of sealing sections 42 and 44 as well as to prevent the impeller from being unduly shifted in one axial direction and being damaged at the grooved outer marginal section. For this purpose, the clearances between the impeller 16 and the housing inner surfaces at the second set of sealing sections 46 and 48 are smaller than those at the first set of sealing sections 42 and 44, namely, less than 30 microns. In the embodiment of the invention illustrated in FIG. 1 of the drawings, the second set of sealing sections 46 and 48 are formed by the cooperation of the inner surfaces of the pump housing directed to the impeller end faces and annular projections 50 and 52 formed on the opposite end faces of the impeller between the first set of sealing sections 42 and 44 and the central section of the impeller. In order to prevent the production of minute particles worn away from the impeller 16 and the pump housing 14 in the case where frictional contacts should occur therebetween, and in order to minimize the loss of torque due to such frictional contacats, at least one of the frictional contact portions, namely, at least one of the inner surfaces of the pump housing 14 and the annular projections 50 and 52 may preferably be formed by a material having a low coefficient of friction, such as a plastic material, a composite plating consisting of Ni and SiC, a compound of an aluminium oxide or oxides and Teflon (trade name), an oil-impregnated sintered metal or alumilite.

The impeller 16 is formed therein with a plurality of axial communication passages 54 disposed radially inwardly of the annular projections 50 and 52 so that the fluid pressure on both sides of the impeller, namely, the fluid pressure in the recess 30 and the fluid pressure in the space 56 defined between the bearing 26 and the impeller 16, are balanced or equalized. Due to the pressure equalizing function of the communication passages 54, the clearances between the impeller 16 and the housing inner surfaces at the second set of sealing sections 46 and 48 are substantially equalized to facilitate smooth rotation of the impeller.

With respect to the motor 13, it has been described that the impeller 16 of the pump 12 is mounted on one end of the shaft 28. The other end of the shaft 28 is journalled by a second bearing 60 which in turn is mounted by a rocking washer 64 on the other end wall 62 of the casing 11 (it has been described that one end of the casing is formed by the outer section 20 of the pump housing 14). The end wall 62 forms a bearing holder and is fitted into the end of the pump casing 11 remote from the pump 12. An "O" ring 66 is interposed between the casing 11 and the end wall 62 to form a liquid seal therebetween. A cylindrical motor housing 68 is fitted into the casing 11 and extends therein between the end wall 62 and the inner section 22 of the pump housing 14. Permanent magnets 70 are secured to the inner peripheral surface of the casing 11 by any conventional securing means. An armature 72 is mounted on the shaft 28 and aligned with the magnets 70. A commutator 74 is mounted on the shaft 28 adjacent to the armature 72. A brush 76 is mounted by a brush holder 78 on the bearing holder 62. A fuel delivery port 80 is formed centrally of the bearing holder 62 while fuel discharge passages 82 are formed in the end wall or bearing holder 62 around the bearing 60 to provide communication between the fuel delivery port 80 and the space within the motor 13.

The end of the casing 11 adjacent to the pump 12 has a radially inwardly extending annular flange 84. A pair of spacers 86 and 88 and a Belleville spring 90 are disposed between the flange 84 and the outer section 20 of the pump housing 14. The other end of the casing 11 is depressed or inwardly deformed at 92 to axially urge the motor 13 and the pump 12 against the spring 90 so that the motor and the pump are axially assembled within the casing 11 so as not to produce any chattering.

The fuel pump 10 of the construction and arrangement described above is usually installed in a fuel tank of a vehicle.

In operation, when the brush 76 is supplied with an electric current, the armature 74 is rotated with the shaft 28 and the impeller 16, so that fuel is sucked through the suction port 18 into the circumferential fluid passage 36 and pressurized to a pressure level of from about 3 to about 4 kg/cm$^2$ and then discharged through the discharge port 38 into the space within the motor 13. The fuel then flows through the space between the armature 72 and the magnets 70 while cooling the armature and is then discharged through the discharge passages 82 and the delivery port 80 into a conduit (not shown) connected to the port 80 so that the pressurized fuel is fed to fuel injectors (not shown) mounted on an engine.

In the pump 12 described above, the sealing function in the radial direction is performed by the first and second sets of sealing sections 42, 44, 46 and 48, whereas the sealing function in the circumferential direction is performed by the radial clearance between the circumferential partition 40 and the grooved outer periphery of the impeller 16. The dimensions of the side clearances at the first and second set of sealing sections 42–48 are determined by the annular projections 50 and 52 provided at the second set of sealing sections 46 and 48. Due to the facts that the axial communication passages 54 are operative to equalize the fluid pressures on the opposite sides of the impeller 16, that the radially outward fluid flows through the first and second sets of sealing sections on the opposite sides of the impeller 16 are substantially equal and that the impeller is slidably axially movable on the motor shaft 28, the side clearances at the first and second sealing sections on the opposite sides of the impeller 16 are kept substantially equal. In addition, since the fluid pressures on the opposite sides of the impeller 16 are equalized, as discussed above, the impeller is not subjected during normal operation to any unduly unbalanced axial thrust force which would cause contact between the annular projection 50 or 52 and the mating inner surface of the pump housing 14.

As described above, the impeller 16 of the pump apparatus 10 is axially movable on the motor shaft 28 and the pump 12 is provided with the first set of sealing sections and, in addition, with a second set of sealing sections at which the side clearances are smaller than those at the first sealing section. These features provide following advantages:

(1) The provision of the second set of sealing sections increases the sealing effect and thus improves the pumping performance of the pump apparatus;

(2) The second set of sealing sections is operative to control the side clearances at the first set of sealing sections and thus improves the pumping performance, stabilizes the pumping operation and improves the durability of the pump apparatus; and (3) The facts that the areas of contact between the impeller and the pump housing at the second set of sealing sections are relatively small and disposed near the axis of the impeller reduce the friction-loss torque, which in turn lowers the pulsation of the discharge pressure of the pump, reduces the noise produced during pumping operation and improves the pumping performance.

It will be understood from the foregoing description that the annular projections 50 and 52, which cooperate with the pump housing 14 to form the second set of sealing sections 46 and 48, also act as spacer means for keeping the major surface areas of the end faces of the impeller 16 closely spaced from the adjacent inner surfaces of the pump housing 14.

Figure 5:
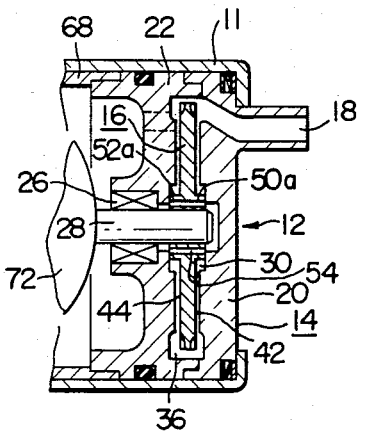
FIGS. 5 and 6 are fragmentary axial sectional views of modified pumps provided with modified spacer means.
Figure 6:
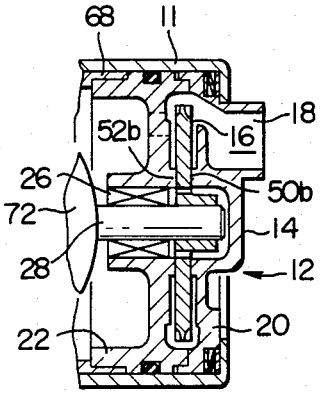
Figure 7:
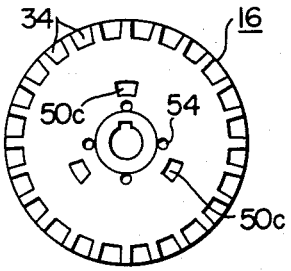
FIG. 7 is an end view of an impeller provided with further modified spacer means.

The spacer means 50 and 52 of the first embodiment of the invention may alternatively be either in the form of central bosses 50*a* and 52*a* formed on the opposite end faces of the impeller 16, as shown in FIG. 5, or in the form of annular projections 50*b* and 52*b* formed on the inner surfaces of the outer and inner sections 20 and 22 of the pump housing 14, as shown in FIG. 6. Further alternatively, the impeller 16 may be provided with an annular projection (not shown) on one of the end faces thereof while the other end face (not shown) of the impeller is planar. In this case, the pump housing may be provided with an annular projection (not shown) on its inner surface directed to the planar end face of the impeller. In place of being in the form of annular projections, the spacer means may be in the form of a plurality of circumferentially spaced protrusions 50*c* formed on the end faces of the impeller 16, as shown in FIG. 7.

Figure 9:
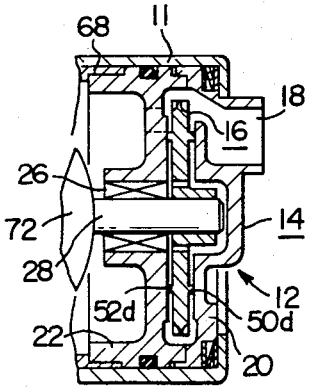
FIGS. 9 and 10 are similar to FIGS. 5 and 6 but illustrate further modified forms of the spacer means.
Figure 10:
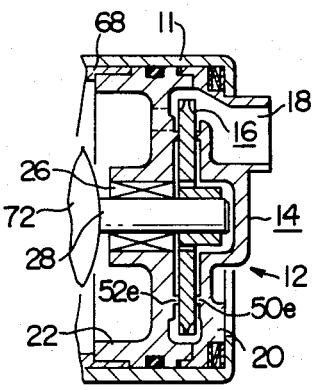

Further alternatively, the spacer means may be in the form of annular projections 50*d* and 52*d* formed on the opposite end faces of the impeller 16 near the grooved outer marginal section of the impeller, as shown in FIG. 9. The annular projections 50*d* and 52*d* may be replaced by similar annular projections 50*e* and 52*e* formed on the inner surfaces of the pump housing 14 directed to planar end faces of the impeller 16, as shown in FIG. 10.

Figure 8:
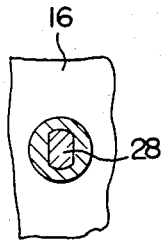
FIG. 8 is a fragmentary cross-sectional view of an impeller and a motor shaft showing a modified driving connection therebetween.

The key 32 which drivingly connects the motor shaft 28 to the impeller 16 may be replaced by other connecting means, such as spline type connection, serration type connection, octagonal connection or such a connection as shown in FIG. 8.

The axial communication passages 54 formed by axial apertures in the impeller 16 may alternatively be in the form of slits or grooves formed in the inner peripheral surface of the through-hole formed in the boss of the impeller for the motor shaft 28.

The pump apparatus has been described and illustrated as being a fuel pump. The present invention, however, is not limtied to fuel pumps but may be applied to pumps for other purposes, such as a pump used to positively circulate lubricant oil through a compressor of a domestic refrigerator.

What is claimed is:

1. A pump apparatus comprising:

a regenerative pump including a pump housing formed therein with suction and discharge ports and a disc-like impeller mounted in said housing for rotation therein and for axial movement within a limited range;

driving means drivingly connected to said impeller to rotate the same for thereby pumping a fluid;

said impeller having substantially constant thickness and having substantially circular and substantially planar end faces and being provided with circumferential rows of radial vane grooves formed in said end faces adjacent to the outer periphery of said impeller;

said pump housing cooperating with said impeller to define a circumferential passage surrounding said circumferential rows of radial vane grooves and communicated with said suction and discharge ports;

said pump housing having substantially circular and substantially planar inner surfaces opposed to said end faces of said impeller, respectively, to cooperate therewith to form a first set of sealing sections extending over substantially the entire surface areas of said impeller end faces, respectively; and means for axially centering said impeller within said pump housing to keep at least the major surface areas of the opposite end faces of said impeller closely spaced axially from said substantially circular inner surfaces of said pump housing, the axial spacings between said impeller and said pump housing being substantially uniform within said first set of sealing sections;

said centering means including spacer means comprising circumferentially continuous annular projections formed on at least one of said impeller and said pump housing in parts of said first set of sealing sections to cooperate with the other of said impeller and said pump housing to form a second set of sealing sections.

2. A pump apparatuas as claimed in claim 1, wherein said centering means further include fluid passage means for substantially equalizing fluid pressures acting on the opposite end faces of said impeller.

3. A pump apparatus as claimed in claim 2, wherein said fluid passage means comprise at least one axial passage extending through said impeller and disposed radially inwardly of said spacer means.

4. A pump apparatus as claimed in claim 3, wherein said annular projections are formed on the opposite end faces of said impeller.

5. A pump apparatus as claimed in claim 4, wherein said annular projections are disposed adjacent to said axial passage.

6. A pump apparatus as claimed in claim 4, wherein said annular projections are radially outwardly spaced from said axial passage.

7. A pump apparatus as claimed in claim 3, wherein said annular projections are formed on said substantially circular inner surfaces of said pump housing.

8. A pump apparatus as claimed in claim 7, wherein said annular projections are disposed adjacent to said axial passage.

9. A pump apparatus as claimed in claim 7, wherein said annular projections are radially outwardly spaced from said axial passage.

* * * * *